United States Patent [19]

Knize et al.

[11] 4,335,827

[45] Jun. 22, 1982

[54] CAN OR CONTAINER AND LID THEREFOR

[75] Inventors: Elmer J. Knize, Chicago; Daniel C. Avers, Oak Park, both of Ill.

[73] Assignee: Lippy Can Company, Ltd., Oak Park, Ill.

[21] Appl. No.: 195,946

[22] Filed: Oct. 8, 1980

Related U.S. Application Data

[63] Continuation-in-part of Ser. No. 79,712, Sep. 28, 1979, abandoned.

[51] Int. Cl.[3] ..... B65D 17/52; B65D 43/26; B65D 41/16

[52] U.S. Cl. ..... 220/284; 220/306; 220/307; 220/324; 150/0.5

[58] Field of Search ..... 220/284, 324, 306, 307; 215/256; 150/0.5; 229/43

[56] References Cited

U.S. PATENT DOCUMENTS

| | | | |
|---|---|---|---|
| 3,458,079 | 7/1969 | Gasbarra | 220/307 |
| 3,716,162 | 2/1973 | Botkin | 220/266 X |
| 3,841,512 | 10/1974 | Botkin | 215/256 X |
| 4,043,482 | 8/1977 | Brown | 220/307 X |
| 4,171,062 | 10/1979 | Allen et al. | 220/319 X |

*Primary Examiner*—George T. Hall
*Attorney, Agent, or Firm*—Dithmar, Stotland, Stratman & Levy

[57] ABSTRACT

A container having a generally cylindrical body closed at the bottom and open at the top with a container rim having a top edge defining an open top and two spaced apart downwardly extending legs, means securing the top of said cylindrical body between the legs upon insertion of the body therebetween, circumferential spaced apart wall sections acting as retaining members exterior to and laterally spaced from the top edge, and a plurality of spaced apart grooves in the exterior surface of the rim near and parallel to the top edge forming a first set of teeth. A removable cover for closing the rim open top having an inverted U-shaped clamping member with an interior leg and an exterior leg and a bight spanning the top edge, the surface of the exterior leg facing the rim having a plurality of spaced apart grooves therein forming a second set of teeth for interlocking relationship with the first set of teeth, the other surface of said exterior leg being in contact with at least some of the circumferentially spaced apart wall sections. The cover may be metal or plastic.

24 Claims, 6 Drawing Figures

FIG. 3
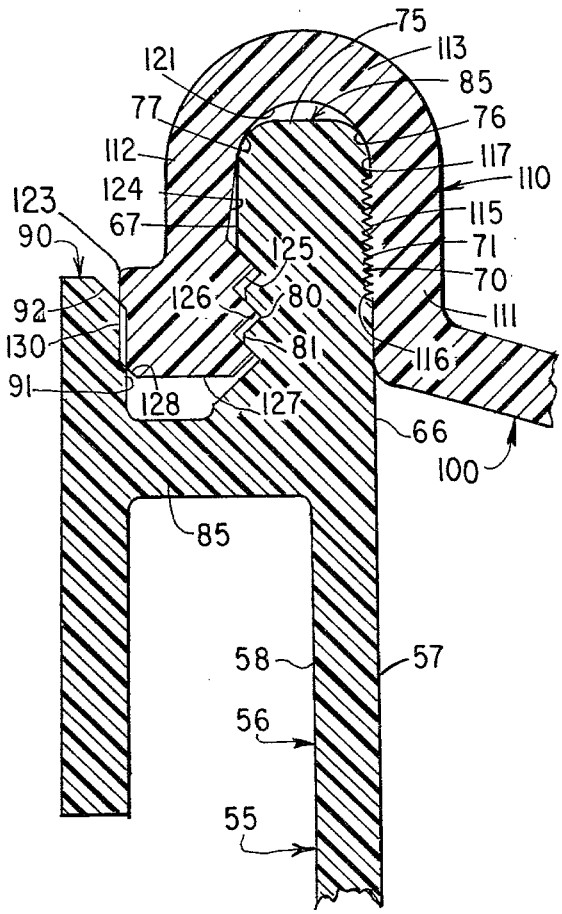
FIG. 4
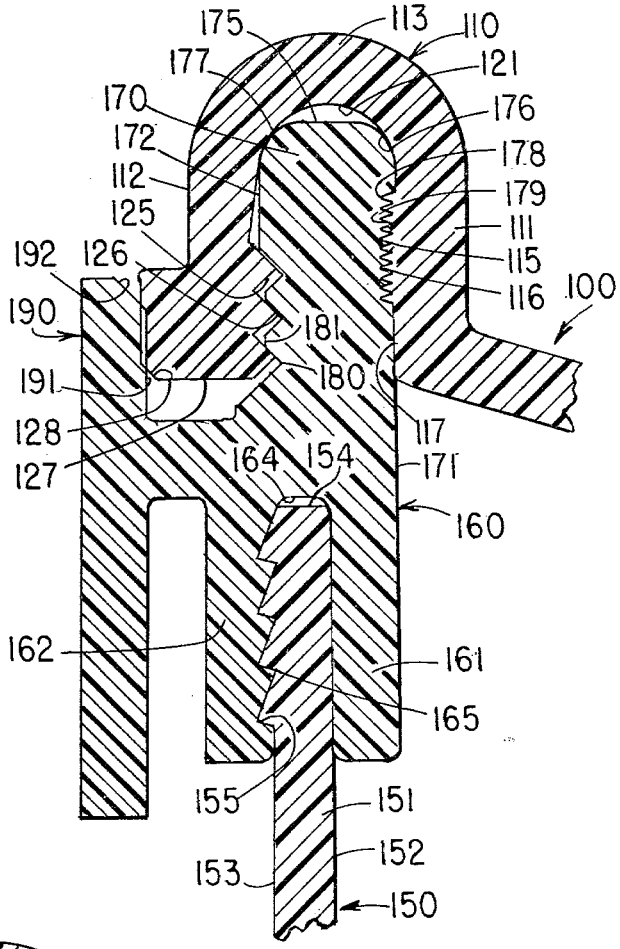
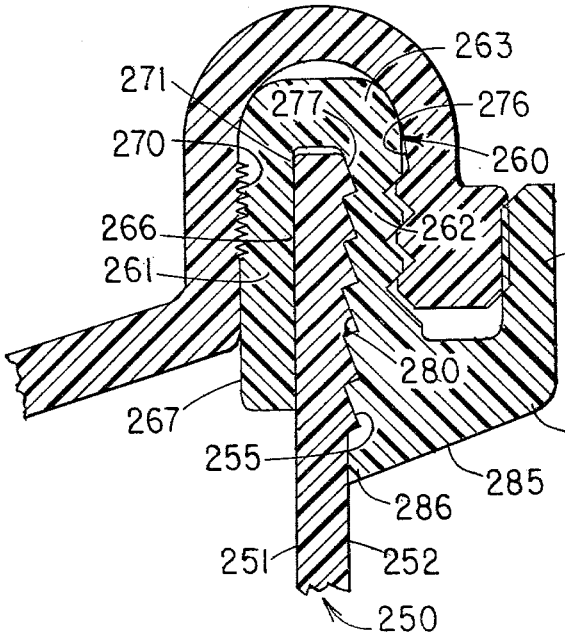
FIG. 5

CAN OR CONTAINER AND LID THEREFOR

RELATED APPLICATIONS

This application is a continuation-in-part of our previously filed and copending application Ser. No. 79,712, filed Sept. 28, 1979; now abandoned.

BACKGROUND OF THE INVENTION

Cans or containers used in the paint industry are subject to intense pressure build up after the container or can lid is sealed to same. Generally, the pressure build up is due to the paint carrier volatilizing and/or sudden drops thereby increasing the pressure inside the sealed can. Various attempts have been made to provide a can or lid design to accommodate the various forces which occurs in paint cans and creates failure of the cover to remain on the rim. Attempts to deal with this problem are illustrated in the Knize U.S. Pat. No. 3,770,161 issued Nov. 6, 1973 for Can or Container And Lid Therefor and Knize U.S. Pat. No. 3,799,338 issued Mar. 26, 1974 for Can Or Container And The Lid Therefor.

Another problem in the paint can industry is providing a lid for a can or container which provides a tight seal but also can be used several times, that is the lid can be removed and then resealed several times without degrading the effectiveness of the seal. Representative examples of prior art attempts to solve this problem are illustrated in Knize U.S. Pat. No. 3,868,041 issued Feb. 25, 1975 for Can Or Container With Resealable Lid as well as Knize U.S. Pat. No. 3,902,630 issued Sept. 2, 1975 for Can Or Container With Locking Lugs For Locking Resealable Lid, the present invention being an improvement of the last named patent.

Various synthetic organic resins such as polypropylene or polyethylene may offer significant advantages over metal and be more readily adaptable to paint cans or containers than metal cans or containers, and accordingly, new lid designs can be provided for these new plastic cans or containers.

BRIEF SUMMARY OF THE INVENTION

An important object of the present invention is to provide a can or container with a reusable and resealable lid therefor that provides a tight seal which will not readily pop off during pressure build up due to failure conditions within the paint can.

Another object of the present invention is to provide a plastic or synthetic organic resin lid for a synthetic organic resin can or container in which the lid design produces continual forces urging the lid into sealing relationship with the can.

Still another object of the present invention is to provide a container having a body with a closed bottom and a top edge defining an open top, interrupted retaining members exterior to and laterally spaced from the top edge, a plurality of spaced apart grooves in the exterior surface of the body near and parallel to the top edge forming a first set of teeth, a removeable cover for closing the open top having an inverted U-shaped clamping member with an interior leg and an exterior leg and a bight spanning the top edge, the interior leg and the bight when the cover is in place closing the open top being in contact respectively with the interior surface of the body and the top edge, the surface of the exterior leg facing the container body having a plurality of spaced apart grooves therein forming a second set of teeth for interlocking relationship with the first set of teeth, the other surface of the exterior leg being in contact with at least some of the interrupted retaining members, whereby the interlocking sets of teeth provide positive stops for the cover and body and the retaining members maintain the sets of teeth in contact.

A further object of the present invention is to provide a container and lid of the type set forth wherein the interrupted retaining members are a plurality of discrete circumferentially spaced apart teeth on the interior upstanding wall sections to create an area to trap paint and create an inner gasket.

A still further object of the present invention is to provide a container and lid of the type set forth wherein the rim has an interior corner joined to an exterior corner by a relatively flat section, contact between the cover and the container rim being principally at the interior and exterior corners.

Another object of the present invention is to provide a container and lid of the type set forth wherein continual pressure on the lid is maintained due to the length of the clamping member being such that the first and second sets of teeth do not fully mesh.

Another important object of the present invention is to provide a container and lid of the type set forth wherein third and fourth sets of teeth are provided respectively on the interior surface of the body in contact with the interior leg and on the exterior facing surface of the interior leg, the third and fourth sets of teeth being seated when the cover is on the container top.

A further object of the present invention is to provide a container having a generally cylindrical body closed at the bottom thereof and open at the top thereof, a container rim having a top edge defining an open top and two spaced apart downwardly extending legs, means securing the top of the cylindrical body between the legs upon insertion of the body therebetween, interrupted retaining members exterior to and laterally spaced from the top edge, a plurality of spaced apart grooves in the exterior surface of the rim near and parallel to the top edge forming a set of teeth, a removeable cover for closing the rim open top having an inverted U-shaped clamping member with an interior leg and an exterior leg and a bight spanning the top edge, the surface of the exterior leg facing the rim having a plurality of spaced apart grooves therein forming a second set of teeth for interlocking relationship with the first set of teeth, the other surface of the exterior leg being in contact with at least some of the interrupted retaining members, whereby the rim is securely fastened to the body and interlocking sets of teeth provide positive stops for the cover and the rim and the retaining members maintain the sets of teeth in contact.

A still further object of the present invention is to provide a container and lid therefor of the type described wherein the means securing the cylindrical body to the rim are at least partly in axial alignment with a part of the first set of teeth.

A final object of the present invention is to provide a container having a body with a closed bottom and a top edge defining an open top, interrupted retaining members exterior to and laterally spaced from the top edge each having an inwardly extending flange, a removeable cover for closing the open top having an inverted U-shaped clamping member with an interior leg and an exterior leg having an engagement portion and a bight spanning the top edge, the interior leg and the bight when the cover is in place closing the open top and being in contact respectively with the interior surface of the body and the top edge, the engagement portion of the exterior leg being in contact with at least some of the inwardly extending flanges on the interrupted retaining members, whereby the cover and the body and the retaining members cooperate to maintain the cover in place.

These and other objects of the present invention may more readily be understood when taken in conjunction with the following specification and drawings, in which:

BRIEF DESCRIPTION OF THE DRAWINGS

FIG. 3 is an enlarged section view of the clamping member and top edge or rim assembly of the present invention;

FIG. 4 is an enlarged section view of a second embodiment of the present invention;

FIG. 5 is an enlarged section view of another embodiment of the present invention.

DETAILED DESCRIPTION OF THE INVENTION

Figure 1:
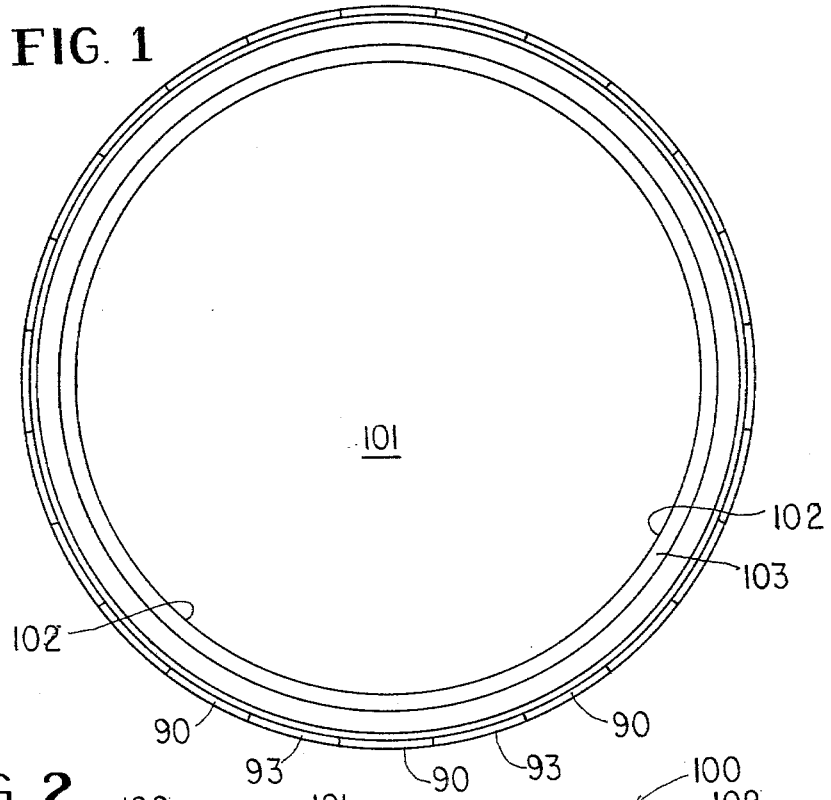
FIG. 1 is a top plan view of the container and lid of the present invention.
Figure 2:
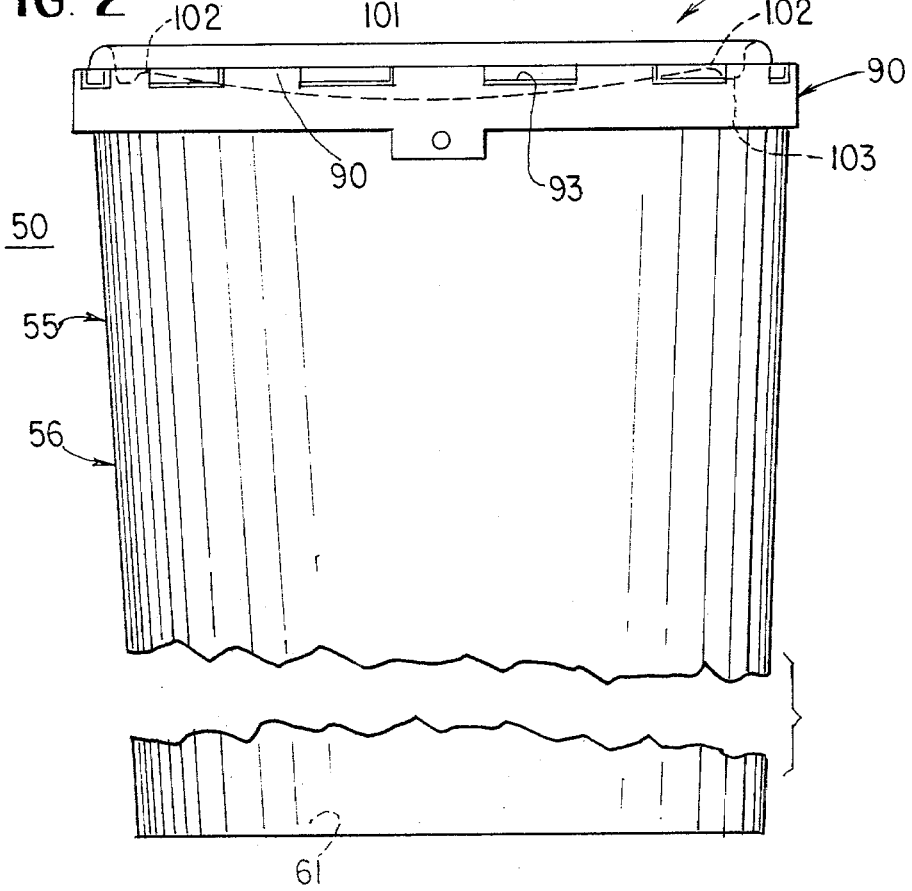
FIG. 2 is a side elevational view of the can or container and lid of the present invention.

Referring now to the drawings, there is disclosed a generally cylindrical container 50 comprised of a body 55 including a side wall 56 having an inner surface 57 and an outer surface 58 closed by a bottom 51. Generally, the body 55 is a single piece of injection molded plastic such as polypropylene or polyethylene, but it is understood that other suitable synthetic organic resins may be used. Due to the injection molding process, generally the body 55 is provided with a draft, that is the body is tapered slightly downwardly to permit ejection from the molds, a $1\frac{1}{2}°$ draft usually being sufficient.

An annular top edge or rim 65 is integrally formed during the injection molding process with the side wall 56 of the body 55 and has an inner surface 66 and an outer surface 67, the inner surface 66 being provided with a plurality of annular grooves 70 defining therebetween annular teeth 71. The annular top edge or rim 65 has a generally flat top surface 75 joined to the inner surface 66 and the outer surface 67 respectively by rounded corners 76 and 77. On the outer surface 67 of the annular rim 65 is provided a plurality of annular grooves 80 defining a plurality of annular teeth 81 therebetween. Preferably, each of the grooves 80 is formed by two angularly disposed walls forming a right angle, the angular pitch of each groove wall being 45°. It is understood, that generally the container 50 which is useful for paint and the like will be cylindrical, although other shapes are not excluded from the scope of the invention. Accordingly, the annular rim 65 is also cylindrical, and therefore, the grooves 70 and 80 as well as the respective sets of teeth 71 and 81 formed thereby are annular. Extending outwardly, but integral therewith, from the bottom of the annular rim 65 is a lip 85 which is generally perpendicular to the longitudinal extent of the cylindrical body 55.

Upstanding from the distal end of the annular lip 85 are a plurality of retaining members 90 each having an interior facing retaining surface 91, the retaining members 90 forming a circle about the cylindrical body 55 and being spaced outwardly from the side wall 56. Each of the retaining members 90 has an inwardly chamfered wall section 92 forming a 45° angle with the longitudinal axis of the cylindrical container body 55. The retainer members 90 are a plurality of wall sections periodically interrupted by prying areas 93 in which no upstanding retaining members are positioned. The retaining members 90 as well as the interrupted areas 93 are generally defined by 15° of arc as measured from the center of the cylindrical body 55, thereby providing twelve alternating retaining members and interrupted or prying areas 93. It is clear and intended to be covered herein alternative dimensions for the interruptions or prying areas 93 and the retaining members 90, since as few as four prying areas 93 may be utilized.

A disk-shaped cover 100 includes a generally concave disk-shaped or circular surface 101 having a circular bead 102 integral therewith and defining the terminal or distal end of the concave disk-shaped portion 101. The bead 102 is integral with an annular channel 103 which is integrally connected to a generally inverted U-shaped circular clamping member 110. The clamping member 110 is comprised of an annular interior leg 111 joined to an annular exterior leg 112 by an arcuate annular bight 113, the entire clamping member 110 as well as the remainder of the cover 100 being integrally molded as one piece. The annular interior leg 111 and annular exterior leg 112, as will be explained, are dimensioned to fit over the annular rim 65 of the container body 55. The interior annular leg 111 has an exterior facing surface 117 in which is provided a plurality of annular grooves 115 defining therebetween annular teeth 116, the annular grooves 115 and teeth 116 being substantially the same dimension and angular pitch as the annular grooves 70 and teeth 71 in the inner surface 66 of the rim 65. The annular bight 113 connecting the two annular legs 111 and 112 of the clamping member 110 has an interior facing surface 121 which, for purposes hereinafter set forth, is generally spaced from the top flat surface 75 of the rim 65 and contacts the rim only at the rounded corners 76 and 77. At the distal end of the exterior leg 112 is an enlargement or boss 123 which has on the interior facing surface 124 thereof a plurality of spaced apart grooves 125 forming therebetween a plurality of teeth 126, the grooves 125 being identical in dimension and angular pitch as the grooves 80 in the exterior surface 67 of the rim 65. The annular enlargement or boss 123 has an annular bottom surface 127 which is generally flat and an angularly disposed or chamfered surface 127 at the exterior bottom corner for sliding cooperation with the surface 92 of the retaining members 90, both surfaces 92 and 127 having an angular pitch of 45°. Lastly the enlargement or boss 123 has an annular or circular abutment surface 130 on the exterior facing side thereof.

In operation, the container 50 is filled with paint or the like and the cover 100 is positioned in registry over the rim 65. As the cover 100 is pushed downwardly over the rim 65, the enlargement 123 and particularly the abutment surfaces 130 engages the retaining members 90. More particularly, the chamfered surface 128 of the enlargement 123 contacts the chamfered surfaces 92 of the retaining members 90 which enhances the sliding contact between the surfaces whereby the enlargement 123 is forced downwardly between the retaining members 90 and the outer surface or exterior facing surface 67 of the rim 65. As the bottommost teeth 126 formed by the grooves 125 in the enlargement 123 come in contact with the uppermost teeth 81 formed by the grooves 80 in the rim 65, positive stops or positions are encountered. Continued downward force on the cover 100 causes the enlargement 123 to move between the retaining members 90 and the rim 65 to the position illustrated in the drawings. Because the distance between the grooves 80 and the inner surface 91 of the retaining members 90 is the same as the distance between the grooves 125 and the abutment surface 130, normally the set of teeth 81 defined by the grooves 80 and the set of teeth 126 defined by the grooves 125 would fully seat. However, as previously discussed, the inner arcuate surface 121 of the bight 113 does not fully seat against the flat surface 75 of the rim 65, the contact being principally at the corners 76 and 77, thereby preventing the two sets of teeth 81 and 126 from fully setting. The retaining members 90 continually urge the enlargement 123 toward the center of the container body 56 and more particularly the force on the enlargement 123 by the retaining members 90 is converted into a downward and inward pull due to the pitch of the teeth 81 and 126. This continual downward and inward pull on the clamping member 110 ensures a tight fit between the cover 100 and the container body 55.

The sets of teeth 71 and 116 formed respectively by the grooves 70 and 115 provide a tight seal between the cover 100 and the body 55, whereby to ensure that fluid in the container 50 does not escape due to shrink areas inherent in plastic manufacturing. Any paint trapped in this area will tend to skim over and become hard due to continued exposure to air creating a gasket of its own. The sets of teeth 71 and 116 are identical in shape and tend to mesh, because they are positioned on the other side of the rim 65 from the sets of teeth 81 and 126 which do not fully mesh.

In the container 50 previously described, the body 55 and the rim 65 are one piece and preferably injection molded, and similarly, the cover 100 and the clamping member 110 are one piece and also injection molded. In a constructional example, the container body 55 has a diameter of 7.27 inches and the length is 8.75 inches. The thickness of the side wall 56 is 0.08 inches and is preferably made out of a synthetic organic resin such as polyethylene or polypropylene. Similarly, the cover 100 and particularly the disk portion 101 thereof is also 0.08 inches thick. The pitch of the grooves 70, 80, and 125 is 45° as is the pitch of the chamfered surfaces 92 and 128. The distance between the abutment surface 130 and the center line of the grooves 125 is 0.134 inches, this dimension also being replicated between the surface 91 and the grooves 80. The distance between adjacent grooves 70 is 0.015 inches and the distance between adjacent grooves 80 is 0.05 inches, while the depth of the grooves 70 is 0.005 inches and the depth of the grooves 80 is 0.02 inches. Finally, when the cover 100 is fully seated on the rim 65 the concave disk surface 101 is angularly disposed to the container body 55 at an angle of $88\frac{1}{2}°$.

Because of variations in molding due to mold tolerances and plastic flow, all the retaining members 90 will not exert the same pressure on the enlargement 123; however, it is believed the most all of the retaining members 90 and particularly the abutment surfaces 91 thereof, will be in physical contact with the aligned or registered portion of the enlargement 123 and particularly the surface 130 thereof. As stated, the continual force provided by the retaining members 90 on the enlargement 123 maintains the cover 100 in the fully sealed conditions thereof.

Removal is effected with a prying tool such as a screw driver or the like which is inserted between the bottom surface 127 of the enlargement 123 and the surface defined by the interruption 93 and the lip 85. Upward pressure forces that section of the enlargement 123 upwardly and the sets of teeth 81 and 126 provide position stops during the upward movement of that portion of the cover 100, thereby preventing the cover 100 from returning from its fully seated position when the prying tool is removed. This is a major advance over the art. Continued prying movement of the cover 100 circumferentially about the container 50 enables the user easily to remove the cover without the prior art difficulty of continual slippage back into the fully seated position. Another important feature of the present invention is the pressure points of the corners 76 and 77 on the rim 65 with the inside or interior surfaces 121 of the arcuate bight 113, thereby preventing the clamping member 110 from being fully seated on the rim 65 and more particularly preventing the sets of teeth 81 and 126 from being fully seated in the respective grooves 125 and 80. This is of critical importance because it provides the continual downward and inward pull on the lid 100 through the clamping member 110 due to the cooperation of the enlargement 123 and the plurality of retaining members 90.

In a second embodiment of the present invention illustrated in FIG. 4, there is provided a three part container 150 defined by a generally cylindrical container wall 151 having an inner surface 152, an outer surface 153 and an annular top edge surface 154. A plurality of outwardly extending annular teeth 155 are provided in the outer facing surface 153 of the cylinder 151. A rim 160 has an inner annular leg 161 and a spaced apart and parallel outer annular leg 162 interconnected by an arcuate dome-shaped annular surface 164. The rim 160 is preferably injected molded in one piece and is provided with a plurality of inwardly facing annular teeth 165 extending from the interior facing surface of the outer leg 162, the teeth 165 being constructed and arranged to fully mesh and lock with the teeth 155 on the container wall 151.

An upstanding mounting portion 170 of the rim 160 is annularly shaped and has an inner surface 171 and an outwardly facing surface 172. The upstanding mounting portion 170 of the rim 160 has a generally flat annularly shaped top edge or surface 175 connected respectively to the inner surface 171 and the outer facing surface 172 by rounded shoulders 176 and 177. A plurality of annular grooves 178 define a set of teeth 179 positioned on the inner surface 171 of the upstanding mounting portion 170 of the rim 160 and a plurality of larger annular grooves 180 define a set of teeth 181 in the exterior facing surface 172. The grooves 178 and set of teeth 179 are preferably dimensioned the same as the corresponding grooves of 70 and 71 in the previously described embodiments 55 and the grooves 180 and set of teeth 181 are preferably dimensioned the same as the previously described grooves 80 and 81. A plurality of retaining members 190 are integrally formed with the rim 160 as were retaining members 90 and have an interior facing abutment surface 191 and a chamfered surface 192. The preferred dimensions of the interrupted retaining members 190 and the function thereof are the same as the previously described interrupted retaining members 90.

The operation of the embodiment 150 is the same as the previously described container 50, the sets of teeth 181 and 179 corresponding respectively to the sets of teeth 81 and 71 of the previously described container 50. The principal difference between the container 150 and the container 50 is in the use of a separate cylindrical wall 151 which may be blow molded to form a stronger container than possible with an injection molding such as previously described. By blow molding the container wall 151 considerably less plastic material can be used for the wall thickness 151, thereby resulting in a substantial saving. Since a blow molded container 151 may have a thinner wall thickness as compared to a thicker wall thickness for the container wall 56 while at the same time result in a stronger container, it can be seen that a substantial saving is effected. Blow molding the container 151 produces an extremely strong container with a thinner wall thickness than can be obtained by injection molding in part due to the stresses generated in the plastic during the injection molding process which are not present during blow molding. An additional feature of blow molding is that the part need not have a draft designed into it since there is no core to remove in blow molding, and this is true whether straight blow molding or injection blow molding is employed. On the otherhand, control only over the outer surface of the blow molded part is possible, and therefore, the cover 100 as well as the rim 160 is preferably injection molded. The described construction 151 can be blow molded even though the teeth 155 are required to be formed simultaneously with the container wall 151 because the teeth 155 are on the outside of the container wall 151 which can be controlled. It is for this reason that the rim 160 which has teeth on both inner and outer surfaces is produced by injection molding rather than blow molding. The cover 100 is also produced by injection molding. Since the inner surface of a blow molded part will not necessarily be uniform in thickness, the performance of an injection molded cover are superior to hold fluids that is subjected to pressure in shipping and handling.

For these reasons, the three part construction illustrated in FIG. 4 is a preferred construction due to the considerable savings effected in the amount of material used in the container wall 151 and bottom (not shown). Dimensions of the container 150 other than the thickness of the container wall may be the same as the dimensions previously described for the container 50. Similarly, the materials preferably are similar, although various vinyls such as polyethylene proprionate or polystyrenes or various co-polymers are also suitable, there being many synthetic organic resins available for injection molding or blow molding which have the required strength under stress, the required resiliency, the required inertness to chemicals and any other art recognized required physical and chemical requirements.

In the embodiment illustrated in FIG. 5, a blow molded cylindrical body 250 has an inner surface 251 and an outer surface 252, the outer surface having a plurality of annular grooves defining a set of locking teeth 255. The cylindrical body 250 fits into a generally U-shaped annular container rim 260 having an interior annular leg 261 and an exterior annular leg 262 connected by an arcuate bight 263. The interior annular leg 261 has an exterior facing surface 266 in abutment with the inner surface 251 of the cylindrical body 250 and an interior facing surface 267 having a plurality of annular grooves 270 forming a set of teeth 271 near the top of the leg 261.

The exterior leg 262 has an exterior facing surface 276 and an interior facing surface 277, the interior surface having a plurality of annular grooves defining a set of locking teeth 280 having the same dimensions and pitch as the set of teeth 255. Insertion of the cylindrical body 250 into the annular rim 260 results in locking engagement of the sets of teeth 255 and 280 preventing disengagement of the annular rim 260 from the cylindrical body 250. The locking engagement is further enhanced by the location of the interrupted retaining members 290.

Extending outwardly from the bottom of the exterior leg 262 is a wedge-shaped lip 285 having the larger dimensioned portion of the wedge 286 adjacent the exterior surface 252 of the container body 250 and the smaller dimensioned portion of the wedge 287 integral with the bottom of the upstanding wall segments of the retaining member 290, which is the same as retaining members 90 and 190. Since the axial position of the sets of teeth 255 and 280 extend beyond the end of the exterior leg 262 of the rim 260 and into the larger end 286 of the wedge-shaped leg 285, forces generated in the retaining member 290 due to the co-action thereof with the enlargement 123 of the cover 100 are transmitted through the wedge-shape lip 285 to the sets of teeth 255 and 280 reinforcing the engagement therebetween. This action allows the fluids to create their own gasket and a savings of materials used on the rim.

There has been provided a container 50 useful for paint as well as other fluids. The first and second sets of teeth 81 and 126 while shown as flat surfaces may be smoothly sinuous and clearly may be of different pitch than described. Similarly, the third and fourth sets of teeth 116 and 179 may be any desired pitch or smoothly sinuous so long as they function to trap material therebetween forming a gasket. The various sealing areas of the container 50 all cooperate to accommodate the variations in part dimensions inherent when using plastics.

Figure 6:
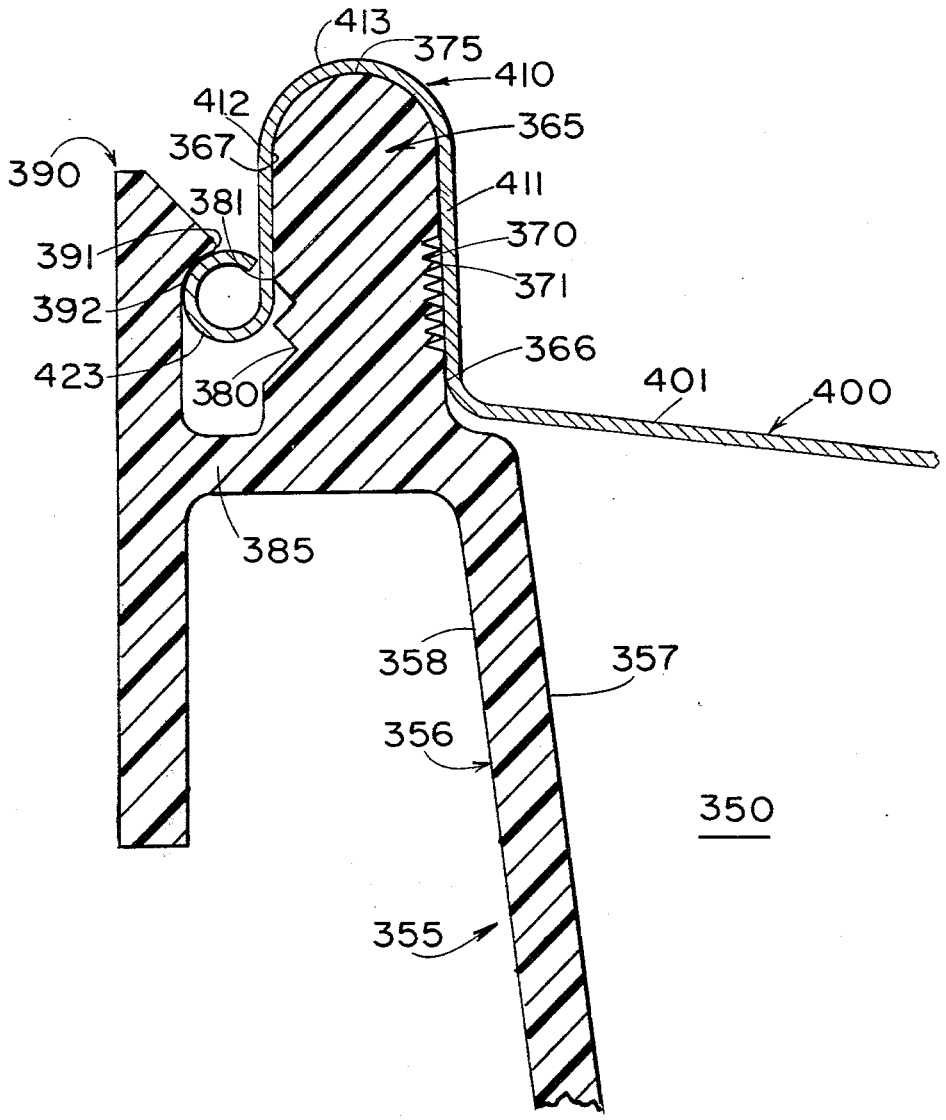
FIG. 6 is an enlarged section view of another embodiment of the present invention.

Referring now to FIG. 6, there is disclosed a generally cylindrical container 350 comprised of a body 355 including a side wall 356 having an inner surface 357 and an outer surface 358 closed by a bottom (not shown). Generally, the body 355 is a single piece of injection molded plastic such as polypropylene or polyethylene, but it is understood that other suitable synthetic organic resins may be used. Due to the injection molding process, generally the body 355 is provided with a draft, that is the body is tapered slightly downwardly to permit ejection from the molds, a $1\frac{1}{2}°$ draft usually being sufficient.

An annular top edge or rim 365 is integrally formed during the injection molding process with the side wall 356 of the body 355 and has an inner surface 366 and an outer surface 367, the inner surface 366 being provided with a plurality of annular grooves 370 defining therebetween annular teeth 371. The annular top edge or rim 365 has an arcuate top surface 375 joining the inner surface 366 and the outer surface 367. On the outer surface 367 of the annular rim 365 is provided a plurality of annular grooves 380 defining a plurality of annular teeth 381 therebetween.

Extending outwardly, but integral therewith, from the bottom of the annular rim 365 is a lip 385 which is generally perpendicular to the longitudinal extent of the cylindrical body 355. Upstanding from the distal end of the annular lip 385 are a plurality of retaining members 390 each having an interior facing retaining flange 391 having an arcuate retaining wall 392, the retaining members 390 forming a circle about the cylindrical body 355 and being spaced outwardly from the side wall 356.

The retainer members 390 are a plurality of wall sections periodically interrupted by prying areas in which no upstanding retaining members are positioned. The retaining members 390 as well as the interrupted areas are generally defined by 15° of arc as measured from the center of the cylindrical body 355, thereby providing twelve alternating retaining members 390 and interrupted or prying areas. It is clear and intended to be covered herein alternative dimensions for the interruptions or prying areas and the retaining members 390, since as few as four prying areas may be utilized.

A disk-shaped cover 400 includes a generally concave disk-shaped or circular surface 401 integrally connected to a generally inverted U-shaped circular clamping member 410. The clamping member 410 is comprised of an annular interior leg 411 joined to an annular exterior leg 412 by an arcuate annular bight 413, the entire clamping member 410 as well as the remainder of the cover 400 being integrally molded as one piece. The annular interior leg 411 and annular exterior leg 412 are dimensioned to fit over the annular rim 365 of the container body 355. At the distal end of the exterior leg 412 is a circular enlargement 423 for engagement with the wall 392 on the flange 391. The cover 400 may be metal rather than a plastic as described in prior embodiments, the flange 391 and enlargement 423 cooperating to effect closure of the container 355 by the cover 400.

While there has been described what at present is considered to be the preferred embodiment of the present invention, it will be apparent that various modifications and alterations may be made therein without departing from the true spirit and scope of the present invention, and it is intended to cover in the claims appended hereto all such variations and modifications.

What is claimed is:

1. A container having a body with a closed bottom and a top edge defining an open top, interrupted retaining members exterior to and laterally spaced from said top edge, a plurality of spaced apart grooves in the exterior surface of said body near and parallel to said top edge forming a first set of teeth, a removeable cover for closing the open top having an inverted U-shaped clamping member with an interior leg and an exterior leg and a bight spanning said top edge, said interior leg and said bight when said cover is in place closing the open top being in contact respectively with the interior surface of said body and said top edge, the surface of said exterior leg facing said container body having a plurality of spaced apart grooves therein forming a second set of teeth for interlocking relationship with said first set of teeth, the other surface of said exterior leg being in contact with at least some of said interrupted retaining members; whereby said interlocking sets of teeth provide positive stops and seal for said cover and said body and said retaining members maintain said sets of teeth in contact.

2. The container of claim 1 wherein said interrupted retaining members are integral with said container body.

3. The container of claim 1 wherein said interrupted retaining members are a plurality of discrete circumferentially spaced apart upstanding wall sections generally parallel to the top portion of said container body.

4. The container of claim 1 wherein said top edge has an interior corner joined to an exterior corner by a relatively flat section, contact between said cover and said container top edge principally being at said interior and exterior corners.

5. The container of claim 1 wherein the length of said clamping member is such that said first and second sets of teeth do not fully mesh.

6. The container of claim 1 wherein said container and retaining members and cover are synthetic organic resins, and said container and retaining members are integral.

7. The container of claim 1 wherein said cover and said inverted U-shaped clamping member are integral, the portion of said clamping member having said second set of teeth on one surface and the other surface in contact with at least some of said retaining members being opposed and having a greater lateral dimension than said interior leg and said bight.

8. The container of claim 1 wherein the interior surface of said body in contact with said interior leg has a third set of teeth therein and the exterior facing surface of said interior leg has a fourth set of teeth therein, said third and fourth sets of teeth being meshed when said cover is on said container top.

9. The container of claim 1 wherein said container is cylindrical, said first and second set of teeth are annular, said cover is disk-shaped and said interior and exterior legs are annular.

10. The container of claim 9 wherein said retaining members are upstanding wall sections the bases of which define a circle outwardly spaced from said exterior leg.

11. The container of claim 1 wherein the grooves forming said first and second sets of teeth have the same angular pitch and depth.

12. A container having a generally cylindrical body closed at the bottom thereof and open at the top thereof, a container rim having a top edge defining an open top and two spaced apart downwardly extending legs, means securing the top of said cylindrical body between said legs upon insertion of said body therebetween, interrupted retaining members exterior to and laterally spaced from said top edge, a plurality of spaced apart grooves in the exterior surface of said rim near and parallel to said top edge forming a first set of teeth, a removable cover for closing the rim open top having an inverted U-shaped clamping member with an interior leg and an exterior leg and a bight spanning said top edge, the surface of said exterior leg facing said rim having a plurality of spaced apart grooves therein forming a second set of teeth for interlocking relationship with said first set of teeth, the other surface of said exterior leg being in contact with at least some of said interrupted retaining members, whereby said rim is securely fastened to said body and said interlocking sets of teeth provide positive stops for said cover and said rim and said retaining members maintain said sets of teeth in contact.

13. The container of claim 12 wherein said rim top edge has an interior corner joined to an exterior corner by a relatively flat section, contact between said cover and said rim being principally at interior and exterior corners, and wherein the length of said clamping member is such that said first and second sets of teeth do not fully mesh.

14. The container of claim 12 wherein said interrupted retaining members are a plurality of discrete circumferentially spaced apart upstanding wall sections generally parallel to the top portion of said container body and integral with said rim.

15. The container of claim 12 wherein said cover and said inverted U-shaped clamping member are integral, the portion of said clamping member having said second set of teeth on one surface and the other surface in contact with at least some of said retaining members having a greater lateral dimension than said interior leg and said bight.

16. The container of claim 12 wherein the interior surface of said rim in contact with said interior leg has a third set of teeth therein and the exterior facing surface of said interior leg has a fourth set of teeth therein, said third and fourth sets of teeth being meshed when said cover is on said container rim.

17. The container of claim 12 wherein said retaining members are upstanding wall sections the bases of which define a circle outwardly spaced from said exterior leg, each of the wall sections having areas on each side thereof wherein a pry tool can be inserted between said cover and said rim.

18. The container of claim 12 wherein the wall thickness of said cylindrical body is less than the wall thickness of said rim.

19. The container of claim 12 wherein said means securing said top of said cylindrical body between said legs is a plurality of outwardly extending serrations on the outside surface of said cylindrical body near the top thereof and a plurality of outwardly extending serrations on the surface of said legs facing and abutting the outside surface of said cylindrical body.

20. The container of claim 19 wherein a portion of said serrations is in axial alignment with a portion of said first set of teeth.

21. A container having a body with a closed bottom and a top edge defining an open top, interrupted retaining members exterior to and laterally spaced from said top edge each having an inwardly extending flange having an arcuate bearing surface, a removable cover for closing the open top having an inverted U-shaped clamping member with an interior leg and an exterior leg having an arcuate engagement portion and a bight spanning said top edge, said interior leg and said bight when said cover is in place closing the open top and being in contact respectively with the interior surface of said body and said top edge, the arcuate engagement portion of said exterior leg being in contact with at least some of said inwardly extending arcuate bearing surfaces on said interrupted retaining members, whereby said cover and said body and said retaining members cooperate to maintain said cover in place and to provide camming surfaces to facilitate removal of said cover.

22. The container of claim 21 wherein said interrupted retaining members are integral with said container body.

23. The container of claim 21 wherein said interrupted retaining members are a plurality of discrete circumferentially spaced apart upstanding wall sections generally parallel to the top portion of said container body.

24. The container of claim 21 wherein said container and retaining members are synthetic organic resins, and said container and retaining members are integral and said cover is metal.

* * * * *